US005160254A

United States Patent [19]

Bell et al.

[11] Patent Number: 5,160,254

[45] Date of Patent: Nov. 3, 1992

[54] APPARATUS AND METHOD FOR COMBUSTION WITHIN POROUS MATRIX ELEMENTS

[75] Inventors: Ronald D. Bell; William C. Gardiner; John R. Howell; Ronald D. Matthews; Steven P. Nichols, all of Austin, Tex.

[73] Assignees: Radian Corporation and the Board of Regents; The University of Texas System, both of Austin, Tex.

[21] Appl. No.: 771,660

[22] Filed: Oct. 4, 1991

Related U.S. Application Data

[63] Continuation-in-part of Ser. No. 554,748, Jul. 18, 1990, abandoned, and a continuation-in-part of Ser. No. 670,286, Mar. 15, 1991.

[51] Int. Cl.[5] ..... F23D 14/16

[52] U.S. Cl. ..... 431/7; 431/326; 431/346

[58] Field of Search ..... 431/7, 10, 160, 170, 431/328, 326, 346, 327

[56] References Cited

U.S. PATENT DOCUMENTS 1,225,381 5/1917 Wedge ..... 431/328
4,197,701 4/1980 Boyum ..... 431/7
4,459,126 7/1984 Krill ..... 431/7

*Primary Examiner*—James C. Yeung
*Attorney, Agent, or Firm*—Klauber & Jackson

[57] ABSTRACT

Apparatus for controlled low $NO_x$ combustion. First and second combustion zones are provided, each filled with a porous high temperature resistant matrix, the void spaces of which provide sites at which substantially all of the combustion occurs. The second zone is downstream of the first zone. Means are provided for mixing fuel and a gaseous source of oxygen and providing the resultant combustible mixture to the input end of the first combustion zone to establish fuel-lean conditions therein; and means for feeding the combustion products from the first zone to the second zone and augmenting same with further oxygen and sufficient additional fuel to create fuel-rich burning conditions therein to complete the oxidation of the products from the first zone. Cooling means are preferably mounted in proximity to the input end of the first combustion zone, for maintaining the temperature of the said combustible mixture at the input end below ignition temperature, thereby limiting the flame produced by combustion in the porous matrix to the downstream side of the cooling means. The corresponding method is also disclosed and claimed.

6 Claims, 2 Drawing Sheets

EMISSIONS OF NOx FROM THE 10/65 PPI SINGLE STAGE BURNER AT 50 SLPM

EQUILIBRIUM NOx FORMATION OF METHANE-AIR REACTIONS

EFFECT OF STAGING ON AXIAL TEMPERATURE DISTRIBUTION AT AN AVERAGE FLOW RATE OF 58 SLPM

APPARATUS AND METHOD FOR COMBUSTION WITHIN POROUS MATRIX ELEMENTS

RELATED APPLICATION

This application is a continuation-in-part of copending application Ser. No. 554,748, filed Jul. 18, 1990, abandoned, and of Ser. No. 670,286 filed Mar. 15, 1991.

FIELD OF THE INVENTION

This invention relates generally to combustion apparatus and methodology, and more specifically relates to an improved combustion apparatus and method which provides increased flame control and stability, and which is especially effective in the reduction of $NO_x$ emissions.

BACKGROUND OF THE INVENTION

Environmental pollution caused by combustion-generated $NO_x$ emissions, is a matter of great concern to the public, and as well to industrial fuel users. Beginning in the 1960's, governmental agencies, indeed prompted by public concern with increasing levels of smog and air pollutants, imposed $NO_x$ reduction requirements upon existing power plants in major metropolitan areas. These restrictions were expanded in the 1970's and 1980's to include virtually all industries with combustion equipment. Industry, accepting the challenge, has already developed a large variety of technologies to meet the new needs. Modifying the combustion process has become the most widely used technology for reducing combustion generated $NO_x$. In addition, a number of flue gas treatment technologies have been developed and are emerging as the primary method of control for certain applications, but have seen limited use where natural gas is the fuel of choice.

Oxides of nitrogen ($NO_x$) are formed in combustion processes as a result of thermal fixation of nitrogen in the combustion air ("thermal $NO_x$"), by the conversion of chemically bound nitrogen in the fuel, or through "prompt-$NO_x$" formation. Thus, in addition to generating "thermal $NO_x$", i.e., by high temperature combination of free nitrogen and oxygen, where the fuels employed by such users (e.g. coal gas) contain substantial quantities of chemically bound nitrogen, certain combustion conditions will favor the formation of undesirable NO-type compounds from the fuel-bound nitrogen. "Prompt $NO_x$" refers to oxides of nitrogen that are formed early in the flame and do not result wholly from the Zeldovich mechanism. Prompt-$NO_x$ formation is caused by 1) interaction between certain hydrocarbon components and nitrogen components and/or, 2) an overabundance of oxygen atoms that leads to early $NO_x$ formation. For natural gas firing, virtually all of the $NO_x$ emissions result from thermal fixation, i.e. "thermal $NO_x$", or from prompt $NO_x$. The formation rate is strongly temperature dependent and generally occurs at temperatures in excess of 1800°K (2800° F.) and generally is more favored in the presence of excess oxygen. At these temperatures, the usually stable nitrogen molecule dissociates to form nitrogen atoms which then react with oxygen atoms and hydroxyl radicals to form, primarily, NO.

In general, $NO_x$ formation can be retarded by reducing the concentrations of nitrogen and oxygen atoms at the peak combustion temperature or by reducing the peak combustion temperature and residence time in the combustion zone. This can be accomplished by using combustion modification techniques such as changing the operating conditions, modifying the burner design, or modifying the combustion system.

Of the combustion modifications noted above, burner design modification is most widely used. Low $NO_x$ burners are generally of the diffusion burning type, designed to reduce flame turbulence, delay the mixing of fuel and air, and establish fuel-rich zones where combustion is initiated. Manufacturers have claimed 40 to 50 percent nominal reductions, but significant differences in the predicted $NO_x$ emissions and those actually achieved have been noted. The underlying cause for these discrepancies is due to the complexity in trying to control the simultaneous heat and mass transfer phenomena along with the reaction kinetics for diffusion burning.

Illustrative of the foregoing and related techniques for $NO_x$ reduction, are the disclosures of the following United States patents:

DeCorso, U.S. Pat. No. 4,787,208 discloses a low-$NO_x$ combustor which is provided with a rich, primary burn zone and a lean secondary burn zone. $NO_x$ formation is inhibited in the rich burn zone by an oxygen deficiency, and in the lean burn zone by a low combustion reaction temperature. Ceramic cylinders are used at certain parts of the combustion chambers.

Furuva et al, U.S. Pat. No. 4,731,989 describes a combustion method for reducing $NO_x$ emissions, wherein catalytic combustion is followed by non-catalytic thermal combustion.

Davis, Jr. et al, U.S. Pat. No. 4,534,165 seeks to minimize $NO_x$ emissions by providing operation with a plurality of catalytic combustion zones and a downstream single "pilot" zone to which fuel is fed, and controlling the flow of fuel so as to stage the fuel supply.

DeCorso, U.S. Pat. No. 4,112,676 shows a combustor generally of the diffusion burning type for a gas turbine engine.

Pillsbury, U.S. Pat. No. 4,726,181 provides combustion in two catalytic stages in an effort to reduce $NO_x$ levels.

Kendall et al, U.S. Pat. No. 4,730,599 discloses a gas-fire radiant tube heating system which employs heterogeneous catalytic combustion and claims low-$NO_x$ catalytic combustion.

Shaw et al, U.S. Pat. No. 4,285,193 describes a gas turbine combustor which seeks to minimize $NO_x$ formation by use of multiple catalysts in series or by use of a combination of non-catalytic and catalytic combustion.

Pfefferle, U.S. Pat. No. 3,846,979 describes low $NO_x$ emissions in a two-stage combustion process wherein combustion takes place above 3300° F., the effluent is quenched, and the effluent is subjected to catalytic oxidation.

Beremand et al, U.S. Pat. No. 4,087,962, discloses a combustor which utilizes a non-adiabatic flame to provide a low emission combustion for gas turbines. The fuel-air mixture is directed through a porous wall, the other side of which serves as a combustion surface. A radiant heat sink is disposed adjacent to the second surface of the burner so as to remove radiant energy produced by the combustion of the fuel-air mixture, and thereby enable operation below the adiabatic temperature. The inventors state that the combustor operates near the stoichiometric mixture ratio, but at a temperature low enough to avoid excessive $NO_x$ emissions. In one embodiment the radiant heat sink comprises a further porous plate.

In U.S. Pat. No. 4,811,555, of which Ronald D. Bell, one of the applicants of the present application, is patentee, there is described a cogeneration system in which $NO_x$ is controlled by the treatment of the turbine exhaust by a combination of combustion in a reducing atmosphere and catalytic oxidation.

In McGill et al, U.S. Pat. No. 4,405,587, for which Ronald D. Bell is a co-patentee, the $NO_x$ content of a waste stream is controlled by treating it and subjecting it to high-temperature combustion in combined reducing and oxidation zones.

Recent work by several of the present co-inventors and others, has resulted in a combustion device which utilizes a highly porous inert media matrix to provide for containment of the combustion reaction within the porous matrix ("PM") —which may comprise fibers, beads, or other material which has a high porosity and a high melting temperature. Preferably, a ceramic foam is used. This ceramic, sponge-like material has a porosity (typically about 90%) which provides a flow path for the combustible mixture. The energy release by the gas phase reactions raises the temperature of the gases flowing through the porous matrix in the postflame zone. In turn, this convectively heats the porous matrix in the postflame zone. Because of the high emissivity of the solid in comparison to a gas, radiation from the high temperature postflame zone serves to heat the preflame zone of the porous material which, in turn, convectively heats the incoming reactants. This heat feedback mechanism results in several interesting characteristics relative to a free-burning flame. These include higher burning rates, higher volumetric energy release rates, and increased flame stability resulting in extension of both the lean and rich flammability limits. In addition to the ability to achieve very high radiant output from a very compact combustor, flame temperature increases are negligible. This is an important consideration with respect to $NO_x$ control purposes.

A one-dimensional mathematical model was constructed that included both radiation and accurate multi-step chemical kinetics. This model was used to predict the flame structure and burning velocity of a premixed flame within an inert, highly porous medium. The various predictions of this model have been discussed by Chen et al. See "The Effect of Radiation on the Structure of Premixed Flames Within a Highly Porous Inert Medium", Y-K Chen, R. D. Matthews, and J. R. Howell, *Radiation, Phase Change, Heat Transfer, and Thermal Systems,* ed. by Y. Jaluria, V. P. Carey, W. A. Fiveland, and W. Yuen (eds.), ASME Publication HTD-Vol. 81, 1987. "Premixed Combustion in Porous Inert Media"; Y-K Chen, R. D. Matthews, J. R. Howell, Z-H Lu, and P. L. Varghese, *Proceedings of the Joint Meeting of the Japanese and Western States Sections of the Combustion Institute,* pp. 266–268, 1987; and "Experimental and Theoretical Investigation of Combustion in Porous Inert Media", Y-K Chen, R. D. Matthews, I-G Lim, Z. Lu, J. R. Howell, and S. P. Nichols, Paper PS-201, *Twenty-Second Symposium (International) on Combustion,* 1988. These papers demonstrate that a porous matrix (PM) combustor can provide a number of advantages over diffusion burners. However, these papers are focused on the development of this new concept, but are not concerned with the problem of $NO_x$ emissions, much less with the effective reduction of same.

The latter issue is, however, addressed in our parent Ser. No. 554,748 application in which low $NO_x$ combustion is effected by a method wherein a fuel, e.g., natural gas, and a source of oxygen, e.g., air, are mixed and the mixture is combusted in at least two successive combustion zones filled with a porous matrix, the void spaces of which provide sites at which substantially all of the said combustion occurs. Preferably, the method utilizes three such combustion zones. The first or most upstream zone is filled with a said porous matrix, and the mixture provided thereto is fuel-lean. In the second successive zone the mixture is fuel-rich; and in the third zone the mixture is fuel-lean.

Ser. No. 670,286, of which this application is a continuation-in-part, addresses a serious problem that has been experienced with PM burners, i.e. flame flashback from the postflame to preflame zones. The latter may include ceramic foam and/or flow mixing and distributing means such as ceramic honeycomb, glass beads or other media, or simply media void mixing space. Flashback of the flame from the postflame zone where combustion is desired, aside from creating potential or actual danger, by definition is uncontrolled burning —which is precisely the condition sought to be avoided in order to preclude or limit $NO_x$ formation. It might be thought that by providing a sufficient rate of fuel/air flow through the PM combustion zone, the problem could be eliminated, i.e. by using a flow rate exceeding the possible rate of back propagation of the flame. It develops, however, that in the real system present in the PM burner, the porous media, as for example where same is in the general shape of a solid cylinder, acts with respect to the normally axial flow of the fuel-air mixture through such cylinder, to cause an uneven rate of flow across a plane transverse to the cylinder. Specifically, there will tend to be flow stagnation at the peripheral walls of the cylinder, as opposed to the generally maximum flow rate occurring at the axis. Accordingly, merely increasing the rate of flow of the fuel-air mixture is not generally sufficient to assure the absence of undesired flame flashback to the preflame zone.

The problem presented by the foregoing is recognized in Fleming, U.S. Pat. No. 4,643,667. In this, Fleming discloses a noncatalytic porous phase combustor comprising a porous plate having at least two discrete and contiguous layers, a first preheat layer comprising a material having a low inherent thermal conductivity, and a second combustion layer comprising a material having a high inherent thermal conductivity and also providing a radiating surface. The presence of the low conductivity material tends to limit the heating in that initial zone, thereby discouraging flashback. The construction recommended by Fleming is, however, a very complex and difficult one to achieve. Furthermore, the presence of the contiguous low conductivity material, while affording advantages as aforementioned, also introduces a pressure drop into the flow, with no commensurate benefits.

In the apparatus of the Ser. No. 670,286 invention, mixing and flow directing means are provided for receiving and mixing a fuel, e.g. natural gas, and a source of oxygen, e.g. air, and forming a flow of the combustible mixture. The combustible mixture is flowed downstream to a combustion zone defined by a porous high temperature-resistant matrix, the void spaces of which provide sites at which substantially all of the combustion occurs, which zone includes an input end for receiving the combustible flow from the mixing and flow directing means. Cooling means are mounted in proximity to the input end of the combustion zone for maintaining the temperature of the combustible mixture at the input end below ignition temperature, to thereby limit the flame produced by combustion in the porous matrix to the downstream or postflame side of the cooling means. The cooling means typically comprises a generally toroidal metal body which is provided with one or more internal cooling channels. This body surrounds, and is in thermal contact with the input end of the combustion zone. Means are provided for circulating a coolant through the body, which coolant can typically be water but may be other liquid media or a gas, including air. The cooling body is so mounted as to be nonintrusive with respect to the porous matrix in the combustion zone, so as to introduce no impedance to the flowing fuel and oxygen source mixture.

The Ser. No. 670,286 invention is applicable to a single stage porous matrix burner, as well as to the multiple stage devices which are disclosed in parent application Ser. No. 554,748. In any of these instances, the cooling means is positioned as to be at the input end (i.e. in advance) of the first (or single) stage whereat combustion is to be effected. The cooling stage in each instance acts to produce a sharp discontinuity in temperature so that even where the flow stagnation effect aforementioned (which tends to occur at the periphery of the porous matrices) is present, there is substantially no danger of flashback from the flame of combustion which exists in the postflame PM zone(s). By eliminating the flashback potential, it is found that extremely stable, well-formed flames result, which in turn provide the highly controlled combustion conditions which are one of the objectives sought after in porous media burners, for the special objective of reducing generation of $NO_x$.

A combustion process is thus provided enabling controlled low $NO_x$ combustion. Fuel and an oxygen source such as air are mixed and formed into a combustible flow stream. The flow stream is passed to an input end of a combustion zone defined by a porous high temperature-resistant matrix. The mixture is combusted at the matrix, the void spaces of which provide sites at which substantially all of the said combustion occurs, and the combustion products are flowed from an output end of the matrix. The input end of the combustion zone is cooled, to maintain the temperature of the combustible mixture at the said input end below ignition temperature, thereby limiting the flame produced by combustion in the porous matrix to the downstream side of the cooling means.

SUMMARY OF INVENTION

In our above-cited prior applications the advantages of a two-stage PM burner were considered to be best achieved by maintaining fuel-rich conditions in the first, i.e. upstream zone, and fuel-lean conditions in the second, i.e. downstream zone. Unexpectedly, it has now been found that outstanding reductions of $NO_x$ and CO are achieved by utilizing a fuel-lean first stage and a fuel-rich second stage. Although not required for $NO_x$ reduction, preferably such an arrangement is used in conjunction with a first-stage cooling means as above described, i.e. which are mounted in proximity to the input end of the first combustion zone. Incorporation of the cooling means is preferred in order to achieve the previously discussed advantage of same, including to best achieve a broad range of equivalence ratios in operation of the invention.

Apparatus for low $NO_x$ combustion in accordance with the invention, may thus comprise first and second combustion zones, each filled with a said porous matrix, and said second zone being downstream of said first zone. Means are provided for mixing fuel and oxygen and providing same to said first combustion zone to establish fuel-lean conditions therein; and means for providing the combustion products from said first zone to said second zone and augmenting same with sufficient fuel and additional oxygen to create fuel-rich burning conditions therein to complete the oxidation of the products from the first zone.

Heat transfer by convection and radiation within the porous matrix element of the first zone preheats the incoming fuel/air mixture to yield a flame temperature which is higher than the theoretical adiabatic flame temperature for said mixture, thus allowing a broader range of fuel/air mixtures to be combusted under fuel lean conditions, and in which heat transfer by radiation from the non-porous walls of the second stage result in an overall lower-flame temperature for the second zone operating in a rich fuel/air ratio condition, and thus minimizing the formation of thermal and prompt $NO_x$.

The porous matrix can comprise a porous ceramic foam, e.g. a reticulated silica-alumina or zirconia foam, in which case the voids are defined by the pores of the foam. Similarly the said matrix can comprise a packed bed—e.g. of ceramic balls, rods, fibers or other media which can withstand the high temperature of the combustion processes. In these instances the voids are defined by the interspaces among the media. It is important to point out here, that in the present invention, unlike certain prior art methodology, substantially all of the process combustion occurs in the void spaces of the matrix—not at surfaces of a ceramic or porous tube or the like. Also to be noted is that differing matrices can be used at the successive zones—and indeed the matrix at a given zone can comprise combinations of one or more contiguous sections, one of which may e.g. comprise a porous ceramic foam and another a packed bed, or so forth.

BRIEF DESCRIPTION OF THE DRAWINGS

The invention will be more readily apparent from the following detailed description, which should be read in conjunction with the appended drawings, in which.

DETAILED DESCRIPTION OF PREFERRED EMBODIMENTS

Figure 1:
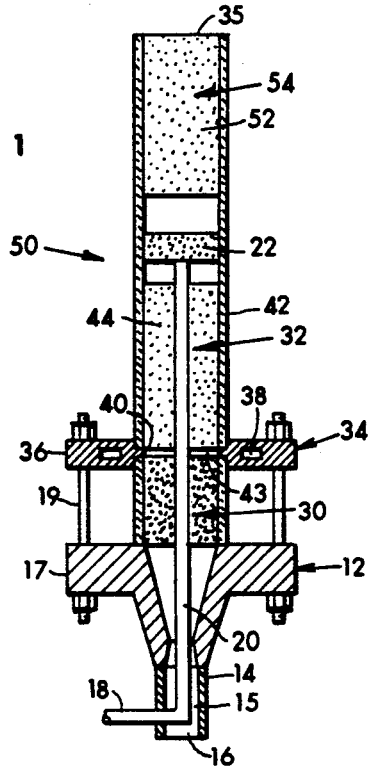
FIG. 1 is a longitudinal sectional view, schematic in nature, of a preferred embodiment of two stage combustion apparatus in accordance with the present invention.

Referring to the drawings and particularly to FIG. 1, combustor or burner apparatus embodying features of the invention is designated generally by the reference numeral 50. The combustor or burner 50 is oriented with its axis vertical such that the flow of gases is upward along the vertical axis. Burner 50 conveniently has a base 12 which may be of metal such as steel. Attached to base 12 is a hollow vertical column 14, the interior of which defines a conduit 15. Column 14 extends upwardly to a flange 17. Threaded rods 19 extend between flange 17 and the outer portion of a toroidally shaped body or ring 36 between which is secured an encapsulating sleeve 42 which may comprise quartz. Premixed reactants (i.e. fuel and air) may enter the burner 50 through a two-stage mixing system (not shown) consisting of a primary mixing section into which fuel and air are introduced before being provided through the inlet 16 for the first stage, and inlet 18 for the second stage. The premixed fuel and air proceed from inlet 16 into a secondary mixing chamber effectively defined within conduit 15. Premixed air and fuel for the secondary stage proceeds via inlet 18 through the conduit 20 to a distributor 22, which can be a porous ceramic cylinder or comprised of other refractory material which includes multiple flow paths for rendering the flow of reactants uniform. In any event, the objective is to provide a well mixed fuel with air or other oxidant combustible mixture at two equivalence ratios, one for the first stage, and the other for the second stage.

A void space 28 is located above this mixing section (at conduit 15) and below the preheat section 30 of the burner core. The burner core in FIG. 1 comprises the preheat or preflame section 30 and a combustion or postflame section 32, each being a porous ceramic cylinder constituted of partially stabilized zirconia (PSZ) having the general appearance of a sponge. Other ceramic foams such as reticulated silica alumina foam are suitable as are packed beds such as beds of saddles, balls, rods and the like; or other formulations with low pressure drop and capable of withstanding the temperatures typically present in combustion apparatus may be used. Foams utilizable in the invention include the silica alumina partially stabilized zirconia as mentioned, silicon nitride and silicon carbide foams of High Tech Ceramics, characterized as having from about 5 to 65 pores per inch (ppi). Typically the ceramic foam of section 30 has about 65 ppi; that of section 32 about 10 ppi. The average porosity of the ceramic media varies from 84 to 87% while the thermal conductivity, for example for the 10 ppi ceramic, is approximately 1 W/m-K.

A cooling means comprising a nonintrusive flame holder 34, is utilized to stabilize the first reaction or combustion zone 44 defined within the porous ceramic section 32. The cooling means 34 is seen to be a generally toroidally shaped body 36 comprised, for example, of brass, which is water cooled by a channel 38 extending internally around the entire toroidal body. Cooling water is pumped through the channel 38 by an inlet and an outlet (not shown) which project from channel 38 to outside body 36. Other cooling media can also be furnished to the interior channel 38 and cooling can also be accomplished by a gas, including air. Water, however, is readily available and is a preferred medium for the cooling purposes. It is noted that the generally toroidal body 36 includes an inwardly extending lip portion 40, which reaches the inner diameter of the flow encapsulation sleeve 42. Hence, it is seen that the innermost lip 40 of body 36 is in virtual contact with the outer periphery of the ceramic core, i.e. with sections 30 and 32. Typically in construction of the ceramic core, several adjacent ceramic sections such as at 30 and 32 are utilized, which may have differing porosity; i.e. as mentioned, in FIG. 1, the core section 30 being actually in the preflame area, may have a porosity of 65 ppi, whereas the main core section 32 whereat the actual flame combustion exists, may have a porosity of 10 ppi. Where separate sections are used as indicated, the cooling means or flame holder 34 is thus inserted between the two sections of the porous ceramic. However, noteworthy is that the said cooling means is thus positioned proximate to the combustible flow input end of core section 32, and is in thermal contact with the flow input end 43 of the first combustion zone 44.

Ignition of the fuel-air mixture flowing through burner 10 can be enabled by any conventional means, including by igniting the flow at the final output 35 or at a convenient intermediate flow point.

Use of flame holder 34 is found to allow a broad range of equivalence ratio and flow rate combinations to be utilized in the apparatus 10, while maintaining a stable reaction zone. (By "equivalence ratio" is meant the ratio of fuel to oxygen on a stoichiometric basis.)

It is found that in apparatus as shown in FIG. 1, the flame stability limits for different equivalence ratios is very substantially increased in comparison to what may be achieved where apparatus similar to FIG. 1 but without the flame holder 34 is operated. Without the flame holder the only effective flame stabilization mechanism is heat loss from the entrance and exit regions of the burner. With the flame holder 34 present, lower flow rates can be used while maintaining the reaction zone at a relatively constant position. Such use also allows for rapid transition between such stable operating conditions. These are important characteristics in practical applications due to the common need to have a turndown ratio between 2:1 and 3:1.

The flow of the combustion products from first combustion zone 44, is seen to be provided to a second combustion zone 52. Zone 52 is also constituted by a porous ceramic matrix 54, which can be the same or different from the matrix 32 in zone 44.

In operation of the two-stage embodiment of FIG. 1, the fuel and oxygen-containing gas to be fed are mixed by conventional mixing means to provide a mixture to chamber 15 containing oxygen which is present in the mixture in 150 to 250%, typically 200% of the stoichiometric amount for the fuel, so that the mixture is a fuel "lean" mixture. The mixture typically has a temperature of 40° to 80° F. if no air preheat is employed. In first combustion zone 44 the mixture of fuel and oxygen-containing gas is ignited, and combustion takes place at a temperature of 2000° to 2800° F., typically 2400° F.

After the fuel-lean mixture has been combusted in zone 44, additional fuel and oxygen-containing gas are added to the product gases from zone 44 via inlet 18 and conduit 20, to produce a fuel "rich" mixture wherein the oxygen present is 60 to 95%, typically 80% of the stoichiometric quantity, and the augmented rich mixture is combusted in the second combustion zone 52 at a temperature of 1800° to 2600° F., typically about 2200° F. This temperature range is low enough to prevent the formation of oxides of nitrogen either by "thermal" or "prompt" reaction mechanisms. Control of this temperature range is accomplished by the combined effects of fuel-air staging and of radiant heat transfer from the surface of the porous media.

In this operation, a portion of the combustion air and/or fuel bypasses the initial premix of fuel and air in the interior of the PM first combustion zone 44. Ignition and combustion of the initial mixture occurs under fuel lean conditions as a result of preheat generated by radiant feedback. Peak flame temperature occurs in this zone as a result of radiant and convective preheat with minimum $NO_x$ formation. The air and/or fuel which is bypassed is then mixed with the products formed in the first combustion zone 44 to oxidize the excess combustibles, prior to exiting the PM burner at 35. The cooling effect of the radiant heat transfer from the PM burner results in a lower temperature than the theoretical flame temperature for the total combined fuel/air mixture in the second zone which is overall reducing. This combined effect results in lower $NO_x$ levels being achieved than would be possible for either a single staged or multiple staged burner employing diffusion burning.

In consequence, significant improvement in terms of $NO_x$ reduction is achieved vis-a-vis passage of all of the fuel and all of the oxygen through a single combustion zone, such as zone 44. Typically, e.g., a reduction of from 50 to 80% is achieved compared to a standard diffusion flame burner or a single stage pre-mix burner wherein combustion occurs either in the matrix or on the surface.

Thus in the process and apparatus depicted in FIG. 1, sufficient fuel mixes with the air in the first (lean) stage of apparatus 50 to provide for a combustion temperature in zone 44 below 1500°K (2500° F.), to minimize thermal $NO_x$. In this stage, the residence time is minimized to convert fuel to CO but not totally to $CO_2$. In the second stage, i.e., at zone 52, the remainder of the fuel is added to obtain additional heat release, but again at a temperature below 1500°K. (2500° F.). Prompt $NO_x$ formation will be retarded because radicals from the first stage will attack the fresh fuel and energy will be rapidly released from the oxidation of CO. At the same time, the presence of cooling means 34 precludes flame back to the preflame section, assuring that the downstream combustion in zone 44 is completely stable and controlled to minimize $NO_x$ as aforementioned.

EXAMPLE

In operation of apparatus 50, burner start-up was effected by delivering a low flow rate, stoichiometric reactant mixture from the first-stage inlet section. The burner was then ignited at the second-stage exit 35. The low flow rate, stoichiometric mixture allowed the reaction zone to propagate upstream through the second-stage burner core. This process was monitored visually through the burner walls 42, which were comprised of quartz. As the flame traveled down into the first-stage burner core, the fuel and air flow rates were gradually increased until the desired first-stage equivalence ratio and flow rate was achieved. If a single-stage experiment was to be performed, the start-up sequence was complete. For two-stage experiments, the burner was allowed to reach steady-state operation in the first stage before the second-stage reactants were introduced through inlet 18.

Burner operating conditions were chosen to allow comparison of emissions from a single-stage versus a two-stage burner at comparable energy release rates and overall equivalence ratios. Single-stage burner emissions were obtained using the two-stage burner apparatus with no additional fuel or air added to the second stage. For the two-stage experiments, both lean/rich and rich/lean staging configurations were investigated. The fuel and air flow rate in the first stage were calculated from, $$\dot{V}_1^{air} = \frac{\dot{V}_1^{tot}}{1 + \left(\frac{\rho_{air}}{\rho_{fuel}}\right)\left(\frac{\phi_1}{AF_{st}}\right)} \quad (1)$$

$$\dot{V}_1^{fuel} = \dot{V}_1^{air}\left(\frac{\rho_{air}}{\rho_{fuel}}\right)\left(\frac{\phi_1}{AF_{st}}\right) \quad (2)$$

where the stoichiometric fuel air ratio is 17.2 for a methane air mixture and the density ratio of air to methane is 1.805. In Equations 1–4, the equivalence ratio ($\phi$) is defined as the stoichiometric air/fuel ratio divided by the actual air/fuel ratio. Thus, equivalence ratios less than one represent lean operating conditions while equivalence ratios greater than one represent rich operating conditions. The second stage air flow rate was derived as a function of the overall equivalence ratio, the first- and second-stage equivalence ratios ($\phi_1$ and $\phi_2$), and the first-stage air flow rate.

$$\dot{V}_2^{air} = \dot{V}_1^{air}\frac{(\phi_1 - \phi_{oa})}{(\phi_{oa} - \phi_2)} \quad (3)$$

where $\phi_{oa}$ represents the overall equivalence ratio of the first and second stage combined. The second-stage fuel flow rate was derived as a function of second-stage air flow rate and equivalence ratio.

$$\dot{V}_2^{fuel} = \dot{V}_2^{air}\left(\frac{\rho_{air}}{\rho_{fuel}}\right)\left(\frac{\phi_2}{AF_{st}}\right) \quad (4)$$

The overall equivalence ratio was maintained in the rich/lean two-stage configuration by setting a desired rich operating condition for the first stage (equivalence ratio and total flow rate of reactants), a lean equivalence ratio for the second stage and calculating the necessary fuel and air flow needed in the second stage to produce the desired overall equivalence ratio. The lean/rich configuration used to make the comparison was achieved by inverting the operating conditions obtained by the above analysis.

Figure 2:
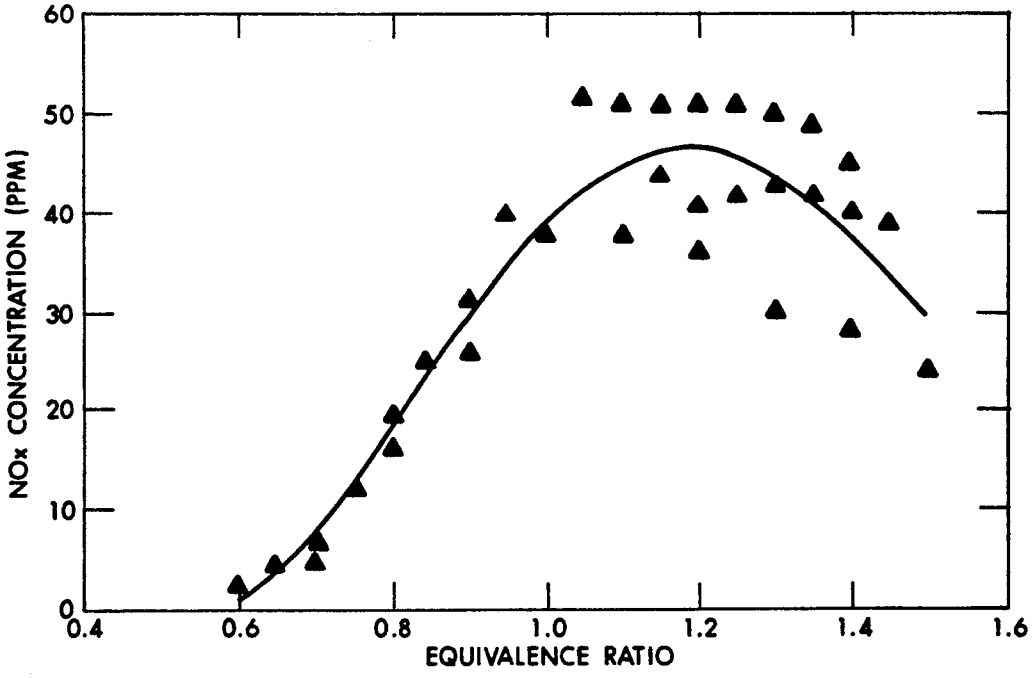
FIG. 2 is a graph of $NO_x$ concentration as a function of equivalence ratios for the apparatus of FIG. 1 where same is operated in a single stage configuration.

The porous media burner 50 was operated at 50 slpm in a single-stage configuration to determine the baseline $NO_x$ formation at various equivalence ratios which exhibited stable burning within the matrix. As shown in FIG. 2, stable burning was achieved at equivalence ratios from 0.6 (67% excess air) to 1.5 (50% excess fuel) $NO_x$ levels at equivalence ratios of 0.6 to 0.8 were quite low, in the range of 5 to 15 ppmv, dry corrected to 3% $O_2$. At high equivalence ratios, 1.0 to 1.5, $NO_x$ levels ranged from 25 to 50 ppmv, dry corrected to 3% $O_2$.

The reason for the higher $NO_x$ levels being formed under operating conditions having an excess of fuel compared to conditions having an excess of oxygen is readily understood, but may be the results of two reaction paths that are taken. Under oxidizing conditions, most of the $NO_x$ is formed by Zeldovich reactions, consisting of the following:

$$O + N_2 \rightarrow NO + N$$

$$N + O_2 \rightarrow NO + O$$

Figure 3:
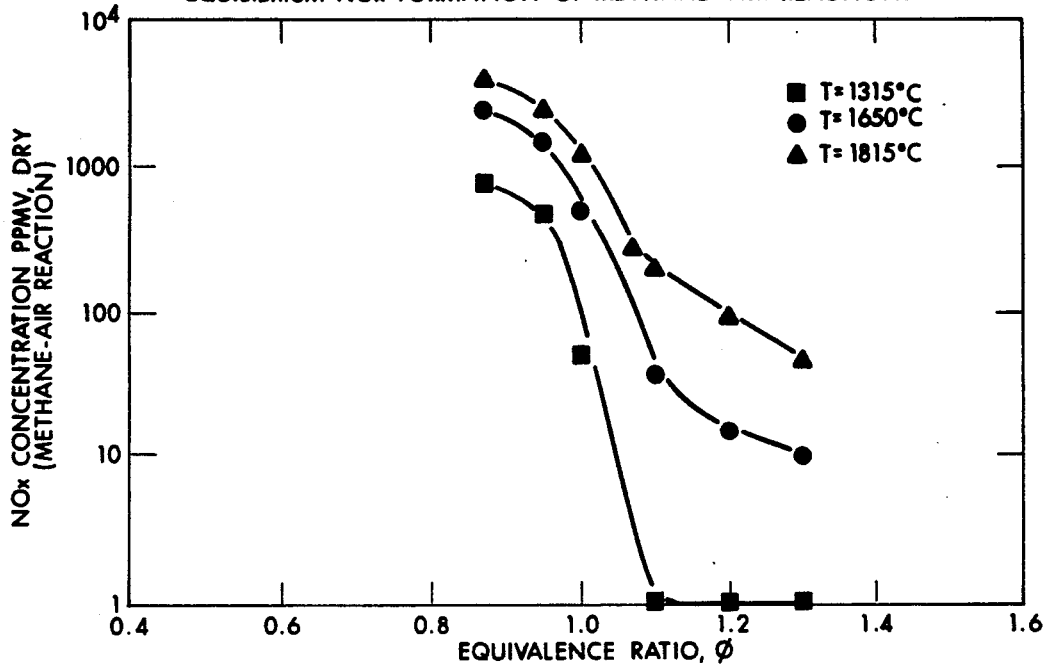
FIG. 3 is a graph showing equilibrium $NO_x$ formation for a mixture of methane and air at various temperatures and equivalence ratios.

The first step is rate-limiting and occurs at elevated temperatures (>2799° F.) (5). At equilibrium, very high levels of $NO_x$ can be formed under oxidizing conditions. FIG. 3 shows equilibrium $NO_x$ formation for a mixture of methane and air at various temperatures and equivalence ratios. At an equivalence ratio of 0.87 (approximately 3% $O_2$), $NO_x$ levels in the range of 1000 to 4000 ppmv are possible at temperatures above 2400° F. However, due to the high activation energy and long residence times required for Zeldovich reactions to go to completion, only a small fraction of the equilibrium levels of $NO_x$ are realized. FIG. 2 shows that at an equivalence ratio of 0.87, only 30 to 35 ppmv of $NO_x$ was formed in the PM burner due to the low residence time in the matrix and the cooling effect of radiant heat transfer.

In fuel-rich flames, equivalence ratios of 1.0 to 1.5, $NO_x$ is formed from HCN which is produced by a reaction between the excess hydrocarbon radicals and elemental nitrogen. Under most conditions, the dominant path from HCN to NO is the sequence initiated by the reaction of HCN with atomic oxygen:

$$CH_2 + N_2 \rightarrow HCN + NH$$

$$HCN + O \rightarrow NO + HC \quad (5)$$

Equilibrium $NO_x$ formation, under fuel-rich conditions, is in the range of 10 to 200 ppm, dry at temperatures above 2800° F. The single-stage data presented in FIG. 2 indicates that, under actual firing conditions, the PM burner will generate 25 to 50% of the equilibrium $NO_x$ levels. The conclusion which can be drawn from these data is that, under oxidizing conditions, $NO_x$ formation is rate limited. Whereas, at conditions of excess fuel, $NO_x$ formation may approach equilibrium conversions, which is the limiting factor for levels of $NO_x$ that are formed.

It will be noted that at temperatures below 2400° F., equilibrium $NO_x$ formation for fuel-rich combustion conditions approaches zero. This points out the need for maintaining reduced temperatures in the PM burner for operation under reducing as well as oxidizing conditions.

Figure 4:
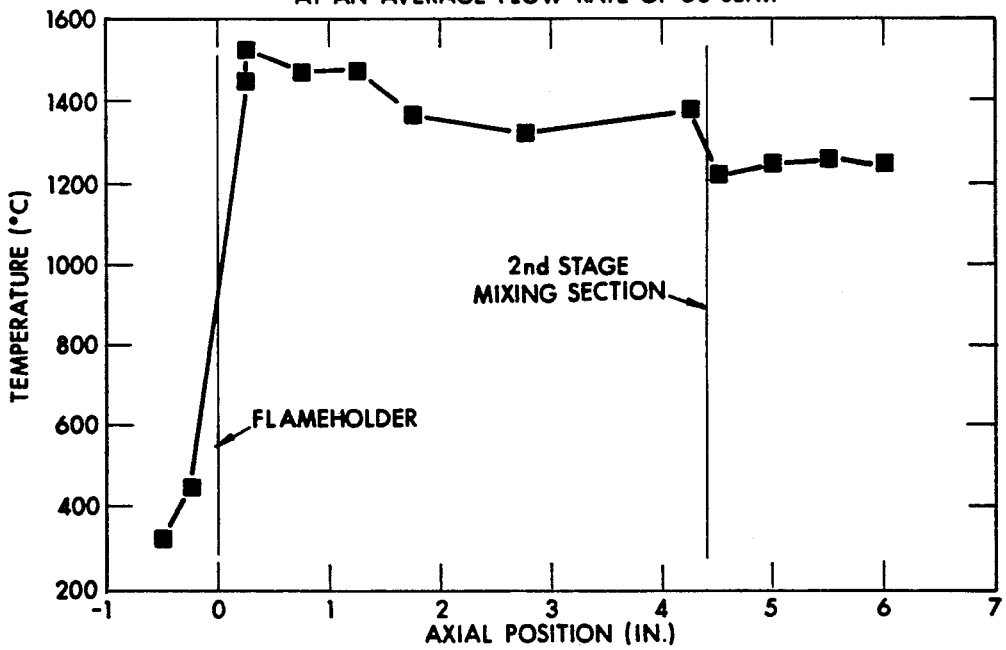
FIG. 4 is a graph, showing axial temperature distributions in combustion apparatus of the type shown in FIG. 1, for a fixed flow rate and specified equivalence ratios in the two stages.

FIG. 4 shows the axial two-stage temperature profile for staged combustion having a first stage equivalence ratio of 1.2 and a second stage of 0.4 for an overall ratio of 0.87 (3% excess $O_2$). The average temperature under staged conditions was 1324° C. (2416° F.). The average axial temperature for single-stage burning at the same conditions was 1420° C. (2588° F.) (4).

The lower temperature profile for combustion under staged conditions is due to the combined effects of distributing fuel and air along the axis of the porous matrix burner and the heat losses in the second stage due to radiant heat transfer.

Table 1 summarizes the results of emissions measurements obtained at various burner operating conditions. Case 1 is single-stage combustion, Case 2 is two-stage combustion with a rich first stage and a lean second stage, and Case 3 is a two-stage combustion with a lean first stage and a rich second stage. The heat release rate (Q) is the mass flow rate of fuel multiplied by the lower heating value of the fuel. These results indicate that NO formation may be reduced in a two-stage burner in which the first and second stages are fuel-lean and fuel-rich, respectively (Case 3). A similar trend in NO emission was observed for an overall equivalence ratio of 1.0.

TABLE 1

Two-Stage vs. Single-Stage Burning in a PM Burner

| Case | $\phi_{oa}$ | $\phi_1$ | $\phi_2$ | Q (kw) | NO (ppm) | CO (%) |
|---|---|---|---|---|---|---|
| 1 | .87 | .87 | — | 4.5 | 23 | 0.01 |
| 2 | .87 | 1.4 | 0.6 | 4.7 | 35 | 1.6 |
| 3 | .87 | 0.6 | 1.4 | 4.7 | 10 | * |
| 4 | 1.0 | 1.0 | — | 5.1 | 36 | 0.8 |
| 5 | 1.0 | 1.4 | 0.6 | 4.9 | 38 | >2.5 |
| 6 | 1.0 | 0.6 | 1.4 | 4.9 | 20 | * |

*No CO detected.

As expected, the best results were achieved under staged conditions with a very lean mixture in the first stage, $\phi=0.6$, and a fuel-rich mixture, $\phi=1.4$, in the second stage (see Cases 3 and 6). Relative flow rates in each stage were varied between Cases 3 and 6 to get the desired overall equivalence ratios.

Cases 1 and 4 are single-stage burning conditions operating at $\phi=0.87$ and 1.0, respectively. Note that $NO_x$ levels of 23 and 36 ppmv, dry, were obtained compared to 10 and 20 ppmv, dry, respectively, for staged burning at the same overall equivalence ratios.

Cases 2 and 5 are two-stage burning conditions with fuel-rich combustion in the first stage and fuel-lean in the second, resulting in overall equivalence ratios of 0.87 and 1.0, respectively. The formation of $NO_x$ was in the 35 to 38 ppmv dry range even with excessive CO emissions (1.6 to >2,5%). Note that cases 3 and 6 not only had the lowest $NO_x$ emissions but also the lowest CO levels.

These results indicate that staged burning with fuel-lean equivalence ratios in the first stage and fuel-rich equivalence ratios in the second stage provides a significant advantage over single-stage combustion at equivalent overall equivalence ratios. The reason for these results is the fact that thermal $NO_x$ formation resulting from Zeldovich mechanisms is retarded in the first stage due to the low flame temperature achieved with high excess air conditions. In the second stage, a fuel-rich mixture is added, but formation of $NO_x$ from the cyano mechanism is retarded due to the combined effects of the unreacted oxygen (at a reduced concentration) from the first stage and the effect of radiant heat transfer lowering the flame temperature at the exit end of the ceramic porous matrix tube. Nondetectable levels of CO for Cases 3 and 6 indicate good combustion characteristics even at a stoichiometric fuel air ratios ($\phi=1.0$).

The following conclusions may be drawn:

1. Two-stage burning in a porous media burner results in lower average axial temperature compared to single-stage combustion;

2. Two-stage burning, in which the first stage is lean and the second stage is fuel-rich, results in lower $NO_x$ and CO emissions than single-stage burning at the same overall equivalence ratio;

3. Two-stage burning, in which the first stage is fuel-rich and the second stage is lean, does not offer a significant advantage over single-stage combustion at the same equivalence ratios; and 4. Two-stage burning, in which the first stage is lean and the second stage is fuel-rich, results in very low $NO_x$ and CO emissions even at overall stoichiometric fuel:air ratios and, as such, affords maximum fuel efficiency with minimum emissions.

It will be understood that various changes and modifications may be made in the embodiments described and illustrated without departing from the invention as defined in the appended claims. It is intended, therefore, that all matter contained in the foregoing description and in the drawings shall be interpreted as illustrative only, and not in a limiting sense.

What is claimed is:

1. Burner apparatus for controlled low $NO_x$ combustion, comprising first and second combustion zones, each filled with a porous high temperature resistant matrix, the void spaces of which provide sites at which substantially all of said combustion occurs, said second zone being downstream of said first zone; means for mixing fuel and a gaseous source of oxygen and providing the resultant combustible mixture to the input end of said first combustion zone to establish fuel-lean conditions therein; and means for feeding the combustion products from said first zone to said second zone and augmenting same with further oxygen and sufficient additional fuel to create fuel-rich burning conditions therein to complete the oxidation of the products from said first zone; and cooling means mounted in proximity to said input end of said first combustion zone, for maintaining the temperature of said combustible mixture at said input end below ignition temperature thereby limiting the flame produced by combustion in said porous matrix to the downstream side of said cooling means, said means being mounted to be non-intrusive with respect to the interior of said porous matrix, thereby presenting no interference with the flow of said combustible mixture through said matrix.

2. Burner apparatus in accordance with claim 1, wherein said cooling means comprises a generally toroidal hollow metal body surrounding and in thermal contact with the input end of said combustion zone, and means to circulate a coolant through said tube.

3. Apparatus in accordance with claim 2, wherein said coolant is water.

4. Apparatus in accordance with claim 2, wherein said coolant is air.

5. A combustion process for controlled low $NO_x$ combustion, comprising:

flowing a combustible mixture of fuel and oxidant through two porous ceramic matrices arranged in series, the first of said matrices being an initial combustion zone for said gaseous mixture, and providing cooling to said mixture as it flows into the surface of said first matrix to maintain the mixture temperature at the said surface below the ignition temperature thereof, to preclude upstream flame-back from said first matrix, said cooling being effected by thermally contacting the input end of said first combustion zone with a cooling means which is mounted to be non-intrusive with respect to the interior of said porous matrix, thereby presenting no interference with the flow of said combustible mixture through said matrix, the combustion in said first matrix being under fuel-lean oxidizing conditions; and additional fuel and oxidant being added to the flow of combustion products from said first matrix to enable combustion in said second matrix under fuel-rich conditions.

6. Burner apparatus for controlled low $NO_x$ combustion, comprising first and second combustion zones, each being laterally bound by non-porous walls and being filled with a porous high temperature resistant matrix, the void spaces of which provide sites at which substantially all of said combustion occurs, said second zone being downstream of said first zone; means for mixing fuel and a gaseous source of oxygen and providing the resultant combustible mixture to the input end of said first combustion zone to establish fuel-lean conditions therein; and means for feeding the combustion products from said first zone to said second zone and augmenting same with further oxygen and sufficient additional fuel to create fuel-rich burning conditions therein to complete the oxidation of the products from said first zone; heat transfer by convection and radiation within the porous matrix element of said first zone preheating the incoming combustible mixture to yield a flame temperature which is higher than the theoretical adiabatic flame temperature for said mixture, thereby allowing a broader range of fuel/oxygen source mixtures to be combusted under fuel lean conditions, and heat transfer by radiation from the non-porous walls of said second zone resulting in an overall lower flame temperature for said second zone operating in said fuel-rich condition, and thereby minimizing the formation of thermal and prompt $NO_x$.

* * * * *